US012714155B2

(12) United States Patent
Ishiguro

(10) Patent No.: US 12,714,155 B2
(45) Date of Patent: Aug. 25, 2026

(54) BRIEFS FOR MALE WEARERS AND METHOD FOR MANUFACTURING SAME

(71) Applicant: Aswemove International, Inc., Burlington (CA)

(72) Inventor: Bryan Ishiguro, Oakville (CA)

(73) Assignee: ASWEMOVE INTERNATIONAL INC., Ontario (CA)

( * ) Notice: Subject to any disclaimer, the term of this patent is extended or adjusted under 35 U.S.C. 154(b) by 0 days.

(21) Appl. No.: 18/821,426

(22) Filed: Aug. 30, 2024

(65) Prior Publication Data

US 2024/0415204 A1 Dec. 19, 2024

Related U.S. Application Data

(63) Continuation-in-part of application No. 17/246,215, filed on Apr. 30, 2021, now Pat. No. 12,150,495.
(Continued)

(30) Foreign Application Priority Data

Apr. 30, 2021 (CA) ..... CA 3116915

(51) Int. Cl.
*A41B 9/00* (2006.01)
*A41B 17/00* (2006.01)
(Continued)

(52) U.S. Cl.
CPC ..... *A41B 9/001* (2013.01); *A41B 9/004* (2013.01); *A41B 17/00* (2013.01); *D03D 15/283* (2021.01);
(Continued)

(58) Field of Classification Search
CPC ..... A41B 9/001; A41B 9/004; A41B 17/00; A41B 2500/20; D03D 15/283; D06C 3/00;
(Continued)

(56) References Cited

U.S. PATENT DOCUMENTS 1,569,621 A * 1/1926 De Lacy ..... D06C 29/00 53/127
2,191,545 A 2/1940 Schneider
(Continued)

FOREIGN PATENT DOCUMENTS

GB 2475234 A * 5/2011 ..... A41H 43/04
WO 0154522 A1 8/2001

*Primary Examiner* — Alissa L Hoey
(74) *Attorney, Agent, or Firm* — Sagacity Legal PLLC

(57) ABSTRACT

A method for manufacturing a brief for a male wearer includes using a stretchable fabric defining a first leg portion, a second leg portion, and a crotch portion. The method includes placing the stretchable fabric into a die assembly such that the crotch portion sits between a core and a cavity. The method includes mating the core with the cavity to cause the core to push a section of the crotch portion into the cavity such that the section is stretched to a stretched state. The section includes a synthetic compound. The method includes applying heat and pressure at the section to cause a volume of the synthetic compound to melt. Further, the method includes cooling the section such that a melted volume of the synthetic compound is infused or incorporated into a remainder of the section and solidified therewithin.

11 Claims, 9 Drawing Sheets

Related U.S. Application Data

(60) Provisional application No. 63/018,175, filed on Apr. 30, 2020.

(51) Int. Cl.
*D03D 15/283* (2021.01)
*D06C 3/00* (2006.01)
*D06C 7/02* (2006.01)

(52) U.S. Cl.
CPC ..... *D06C 3/00* (2013.01); *D06C 7/02* (2013.01); *A41B 2500/20* (2013.01); *A41B 2500/50* (2013.01); *D10B 2331/02* (2013.01); *D10B 2331/04* (2013.01); *D10B 2501/02* (2013.01)

(58) Field of Classification Search
CPC ..... D06C 7/02; D10B 2501/02; D10B 2331/102; D10B 2331/04; A41D 2500/50
See application file for complete search history.

(56) References Cited

U.S. PATENT DOCUMENTS 2,285,967 A 6/1942 Hardy
2,460,674 A 2/1949 Lajos
2,616,084 A 11/1952 Shearer
2,641,257 A 6/1953 Rutledge
2,867,889 A 1/1959 Thompson, Jr.
2,983,274 A 5/1961 Henry
2,999,295 A * 9/1961 Manning ..... B65H 23/1888 324/167
3,006,175 A 10/1961 Morgan
3,029,492 A * 4/1962 Cutler ..... D06C 29/00 427/176
3,163,167 A * 12/1964 Chisholm ..... A41C 3/142 D2/706
3,322,120 A 5/1967 Wyss
3,434,478 A 3/1969 Cohen
3,838,481 A * 10/1974 Kuroda ..... D06C 3/062 26/77
3,981,310 A 9/1976 Donaghy
4,202,853 A 5/1980 DiTullio
4,481,951 A 11/1984 Cole
4,555,378 A 11/1985 Martin
4,572,195 A 2/1986 Hyams
5,131,100 A 7/1992 Atwater
5,529,826 A * 6/1996 Tailor ..... B32B 27/302 428/36.1
5,855,124 A 1/1999 Donaghy
5,987,721 A * 11/1999 Morris ..... D06C 21/00 28/166
6,299,505 B1 10/2001 Huang
6,398,620 B1 6/2002 Huang
7,214,120 B2 5/2007 Kaye
7,422,508 B2 9/2008 Bentham
7,437,774 B2 10/2008 Baron
7,442,110 B2 10/2008 Gaudet
7,631,369 B2 12/2009 Geiwald
7,722,432 B2 5/2010 Wood
7,774,865 B2 8/2010 Miller
7,776,770 B2 8/2010 Wang
8,601,616 B2 * 12/2013 Radford ..... A41B 9/02 2/403
8,827,765 B2 * 9/2014 Zhang ..... A41C 3/146 450/39
9,044,329 B2 6/2015 Ziehler
9,210,955 B2 12/2015 Dandapure
9,232,823 B2 1/2016 Mitchell
9,332,792 B2 5/2016 Harber
10,045,570 B2 8/2018 Hoeven
10,085,492 B2 10/2018 Polidan
10,165,801 B2 1/2019 Blibech
10,342,266 B2 7/2019 Oh
10,542,782 B2 1/2020 Shupe
10,779,578 B2 9/2020 Van Tiel
10,798,976 B2 * 10/2020 Berkowitz ..... A41D 27/24
10,834,974 B2 11/2020 Bigney
10,863,779 B2 12/2020 Guarnaschelli
D908,312 S 1/2021 Karon
11,147,718 B2 10/2021 Lavon
11,213,078 B2 1/2022 Mientjes
11,547,613 B2 1/2023 Ashraf
11,606,992 B2 3/2023 Pezzimenti
11,905,626 B2 * 2/2024 Liao ..... A41B 9/001
11,980,242 B2 * 5/2024 Thompson ..... A41D 31/125
12,161,172 B2 * 12/2024 Miller ..... A41C 3/0085
12,433,348 B2 * 10/2025 Tam ..... A41C 3/10
2003/0056703 A1 * 3/2003 Blake ..... A41D 31/185 112/475.08
2004/0224604 A1 * 11/2004 Luk ..... A41C 3/10 450/39
2005/0208875 A1 * 9/2005 Jagaric ..... A41C 3/144 450/39
2006/0005301 A1 1/2006 Taylor
2006/0162052 A1 7/2006 Stankowski
2008/0132133 A1 6/2008 Yasui
2008/0229487 A1 9/2008 Kweon
2010/0075103 A1 * 3/2010 Miyamoto ..... B32B 3/28 156/244.11
2011/0258756 A1 * 10/2011 Avgustopulo ..... A41B 9/02 2/403
2012/0204325 A1 * 8/2012 Todd ..... A41B 9/02 2/403
2012/0255201 A1 10/2012 Little
2014/0215685 A1 8/2014 Bush
2016/0074311 A1 * 3/2016 Massey-Brooker ... A61Q 19/00 424/70.13
2016/0309792 A1 10/2016 Adriaansen
2016/0338415 A1 11/2016 Ai Hara
2017/0071275 A1 3/2017 Darby
2017/0226691 A1 * 8/2017 Farmer ..... B32B 7/05
2017/0290377 A1 * 10/2017 Liu ..... A41C 3/14
2018/0132538 A1 5/2018 Yan
2018/0338548 A1 * 11/2018 Wyner ..... A41D 13/0017
2019/0048521 A1 2/2019 Meemaduma
2019/0125002 A1 5/2019 Cox
2019/0216140 A1 * 7/2019 Turlan-Van Der Hoven ..... A41C 3/144
2019/0233988 A1 8/2019 Harada
2020/0297040 A1 9/2020 Weber-Unger
2020/0397069 A1 * 12/2020 Liu ..... A41C 3/12
2021/0169153 A1 6/2021 Inselberg
2021/0212386 A1 7/2021 Jamieson
2021/0259326 A1 8/2021 Shaughnessy
2021/0274856 A1 9/2021 Blythe
2022/0047022 A1 * 2/2022 Almog ..... D04B 1/243
2022/0346461 A1 11/2022 Wittrock
2022/0378116 A1 12/2022 Morris, V
2023/0043323 A1 2/2023 Vitarana
2024/0100757 A1 * 3/2024 Nguyen ..... B32B 27/322
2024/0116283 A1 * 4/2024 Feix ..... A41H 43/04
2024/0389680 A1 * 11/2024 Zarabi ..... A41B 9/004

* cited by examiner

TABLE 1

| | |
|---|---|
| XXXXXXX | F1 |
| X X X X | F2 |

TABLE 2

| | |
|---|---|
| ∘ ∘ ∘ | G |
| ××××××× | F1 |
| × × × × | F2 |

TABLE 3

| | |
|---|---|
| • • • | H |
| ××××××× | F1 |
| × × × × | F2 |

TABLE 4

| | |
|---|---|
| • • • | H |
| ××××××× | F1 |
| × × × × | F2 |

BRIEFS FOR MALE WEARERS AND METHOD FOR MANUFACTURING SAME

CROSS REFERENCE TO RELATED APPLICATION

The present application is a continuation-in-part of U.S. Non-Provisional application Ser. No. 17/246,215, filed Apr. 30, 2021, entitled "SEAMLESS MALE GARMENT", which claims priority from U.S. Provisional Application No. 63/018,175, filed Apr. 30, 2020, entitled "SEAMLESS MALE GARMENT", both of which are incorporated by reference herein in its entirety.

BACKGROUND OF THE INVENTION

Conventional men's undergarments, such a men's briefs, are uncomfortable for the wearer as they exhibit low breathability. Further, presence of seams in undergarments exacerbates wearer discomfort. Moreover, conventional men's undergarments lack the ability to conform to one or more of the wearer's body parts, for example, the wearer's genitals.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention and explain various principles and advantages of those embodiments.

Figure 1:
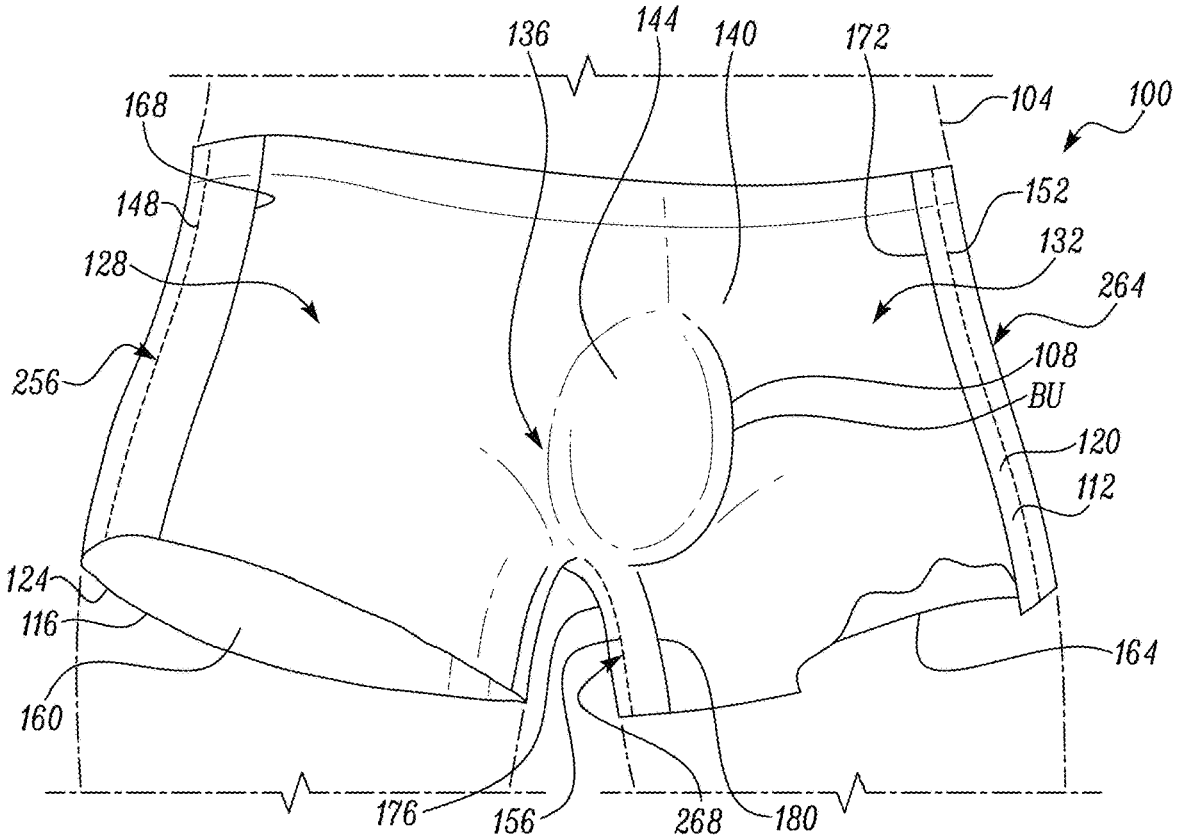
FIG. 1 is a front perspective view of an exemplary brief, which is a seamless male undergarment, for a male wearer, in accordance with some embodiments.
Figure 2:
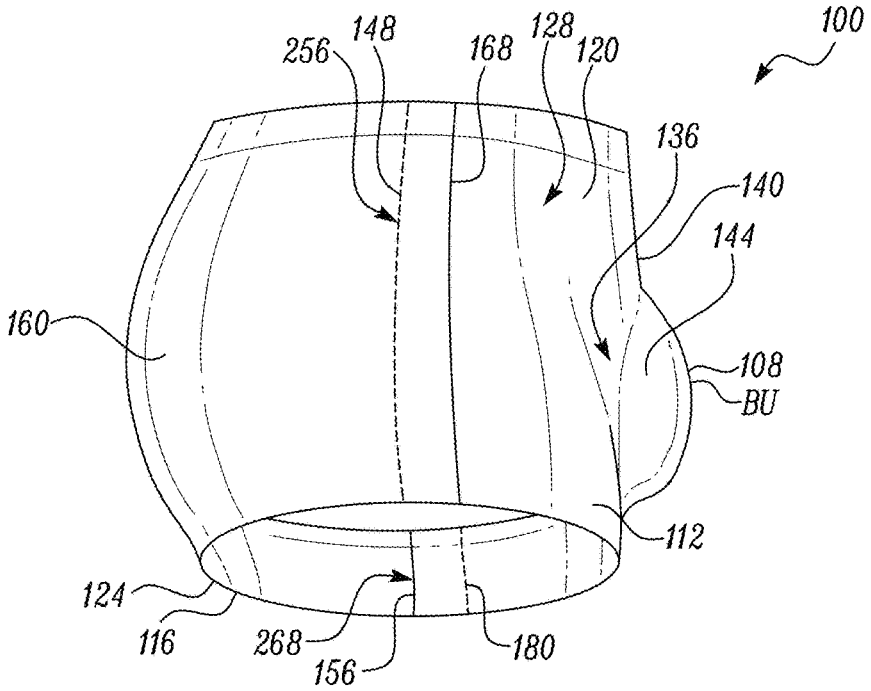
FIG. 2 is an exemplary side view of the brief of FIG. 1, in accordance with some embodiments.
Figure 3:
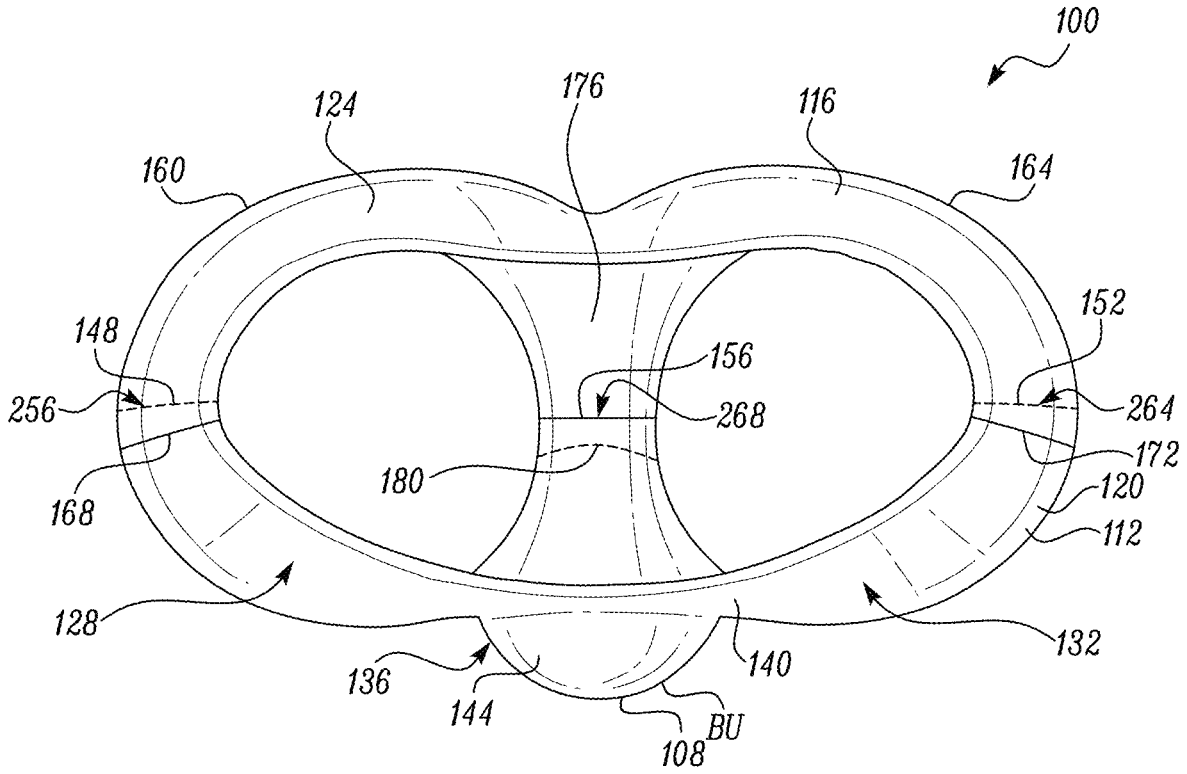
FIG. 3 is an exemplary top view of the brief of FIG. 1, in accordance with some embodiments.
Figure 4:
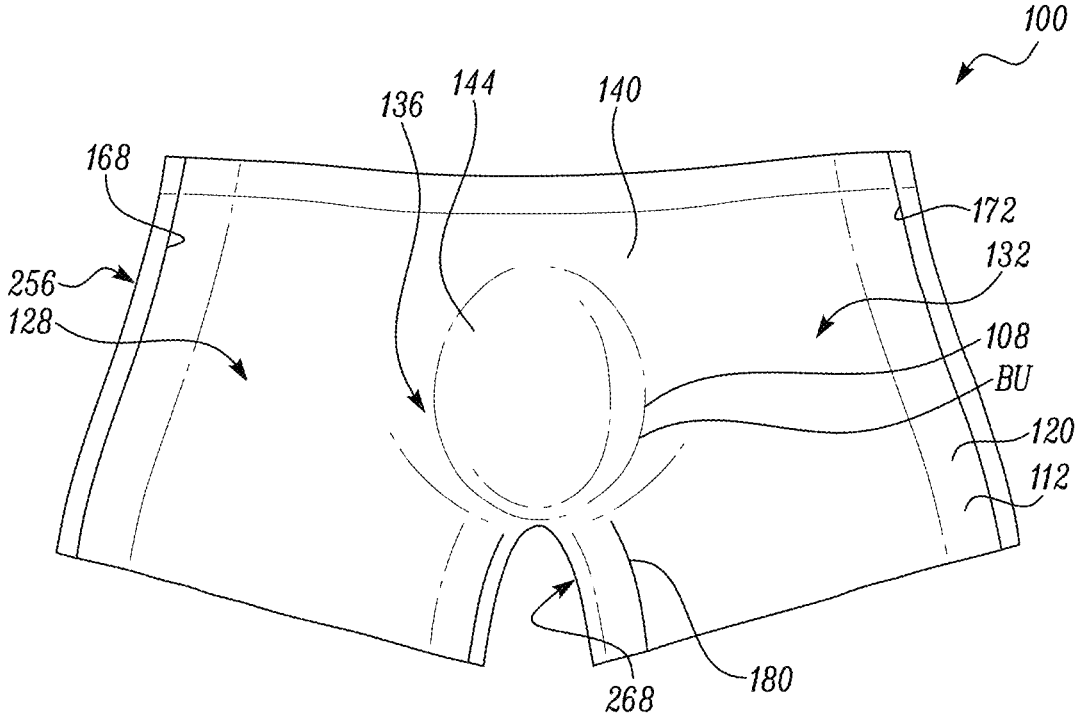
FIG. 4 is an exemplary front view of the brief of FIG. 1, in accordance with some embodiments.
Figure 5:
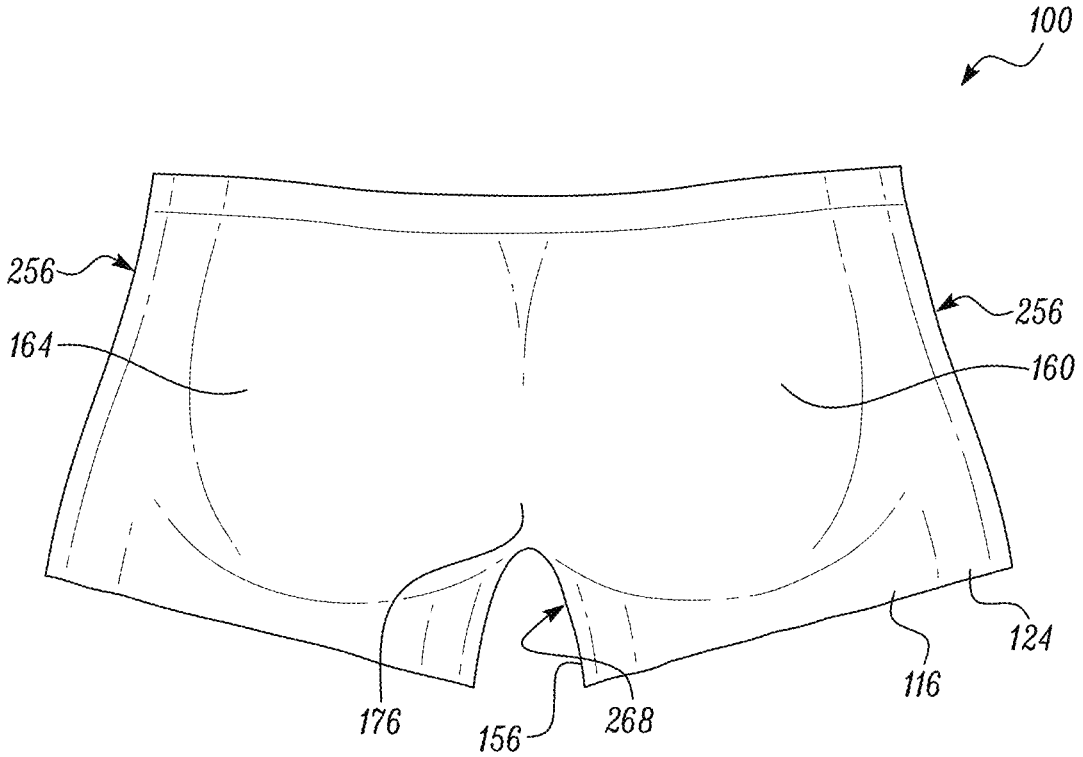
FIG. 5 is an exemplary rear view of the brief of FIG. 1, in accordance with some embodiments.
Figure 6:
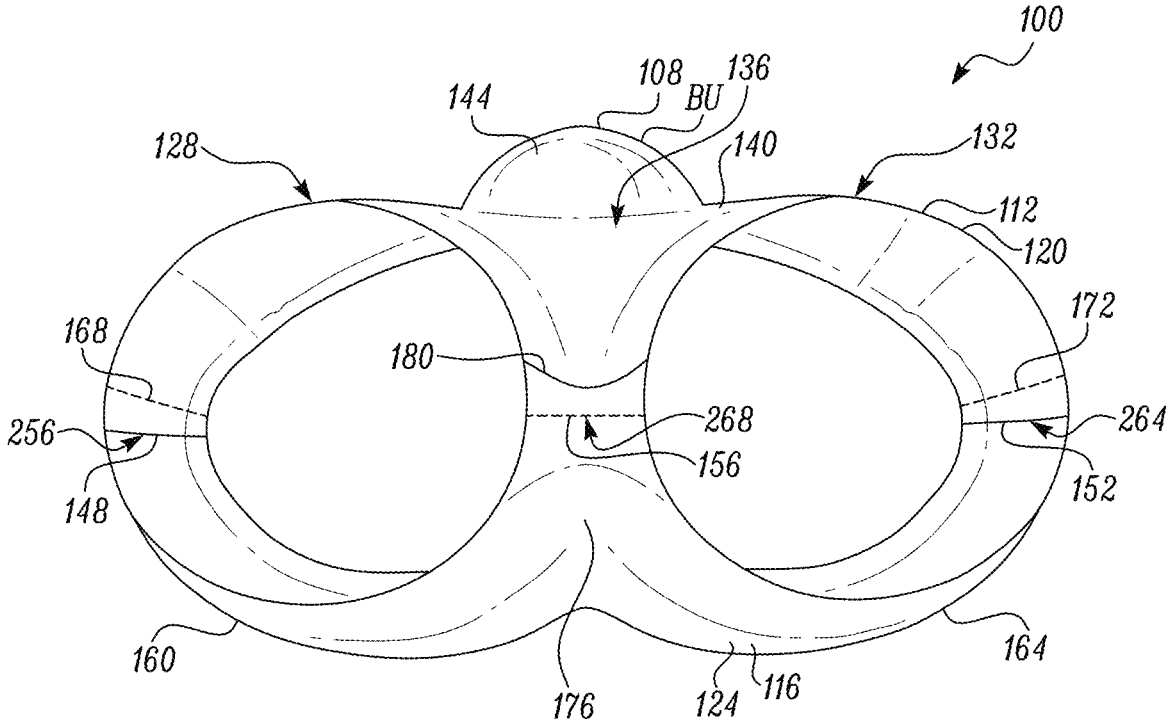
FIG. 6 is an exemplary bottom view of the brief of FIG. 1, in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments.

The apparatus and method components have been represented where appropriate by conventional symbols in the drawings, showing only those specific details that are pertinent to understanding the embodiments so as not to obscure the description with details that will be readily apparent to those of ordinary skill in the art having the benefit of the description herein.

DETAILED DESCRIPTION OF THE INVENTION

The embodiments described herein are related to a brief for a male wearer. More particularly, the embodiments described herein are related to a method for manufacturing a brief. The brief provides for a pouch to enclose genitals of a male wearer. The pouch provides improved breathability to the wearer's genitals.

In one aspect, a method for manufacturing a brief for a male wearer is described. The method includes using a stretchable fabric defining a first leg portion, a second leg portion, and a crotch portion integrally and contiguously extending between the first leg portion and the second leg portion. The method includes placing the stretchable fabric into a die assembly such that the crotch portion sits between a core and a cavity of the die assembly. Further, the method includes mating the core with the cavity to cause the core to push a section of the crotch portion into the cavity such that the section is stretched from a non-stretched state to a stretched state with respect to a remaining section of the crotch portion. The section includes a synthetic compound. The method includes applying heat and pressure at the section to cause a volume of the synthetic compound to melt while retaining the section in the stretched state. Further, the method includes cooling the section while retaining the section in the stretched state such that a melted volume of the synthetic compound is infused or incorporated into a remainder of the section and solidified therewithin. The infusion or the incorporation and the solidification cause the section of the crotch portion to acquire a shape as that acquired in the stretched state and be retained in the shape to form a pouch seamlessly integrated with the remaining section of the crotch portion. The pouch is configured to enclose genitals of the male wearer when the brief is worn by the male wearer.

In another aspect, a brief for a male wearer is described. The brief includes a stretchable fabric including a satin weave synthetic composite fabric with elongated nano fibres. The stretchable fabric defines a first leg portion, a second leg portion, and a crotch portion integrally and contiguously extending between the first leg portion and the second leg portion. The crotch portion defines a pouch to enclose genitals of the male wearer when the brief is worn by the male wearer. The pouch is formed by a section of the crotch portion that is stretched outwardly to a stretched state to define a bulge with respect to a remaining section of the crotch portion. The pouch is seamlessly integral with the remaining section of the crotch portion. Each of the remaining section of the crotch portion, the first leg portion, and the second leg portion, defines first holes and the pouch defines second holes. The first holes define a diameter in a range of 0.01 millimetres (mm) to 0.024 mm in between warp and filament yarn, and the second holes define a diameter in a range of 0.025 mm to 0.05 mm in between warp and filament yarn.

Reference will now be made in detail to specific embodiments or features, examples of which are illustrated in the accompanying drawings. Generally, corresponding reference numbers may be used throughout the drawings to refer to the same or corresponding parts, for example, 1, 1', 1", 101 and 201 could refer to one or more comparable components used in the same and/or different depicted embodiments.

Referring to FIGS. 1 through 6, a garment, and, more particularly, a brief 100 is described by way of reference to various isometric views. The brief 100 corresponds to an undergarment wearable by a male wearer 104 (see FIG. 1) directly over the wearer's body such that portions of the brief 100 comes in contact with the wearer's body. Although aspects in the present disclosure been described in relation to the brief 100, said aspects are applicable to a variety of other garments, such as men's swimwear, men's shorts, men's sweatpants, men's trousers, men's pants, men's underpants, and/or the like apparels usable by men. According to one of the aspects, the brief 100 includes a pouch 108 configured to enclose genitals of the male wearer 104 when the brief 100 is worn by the male wearer 104.

The brief 100 includes a first panel 112 (which is a front panel of the brief 100) and a second panel 116 (which is a rear panel of the brief 100). In an embodiment, each of the first panel 112 and the second panel 116 is made from the same fabric material. Alternatively, in an embodiment, the first panel 112 and the second panel 116 are made from different fabric materials. As an example, at least one of the first panel 112 and the second panel 116 includes, but is not limited to, a fabric which includes a satin weave synthetic composite fabric having elongated nano fibres. The fabric forming each of the first panel 112 and the second panel 116 is a stretchable fabric that enables the brief 100 to adjust and conform to a body structure of the male wearer 104. For the purposes of the present disclosure, the first panel 112 is referred to as a first stretchable fabric 120. Similarly, the second panel 116 is referred to as a second stretchable fabric 124.

Figure 7A:
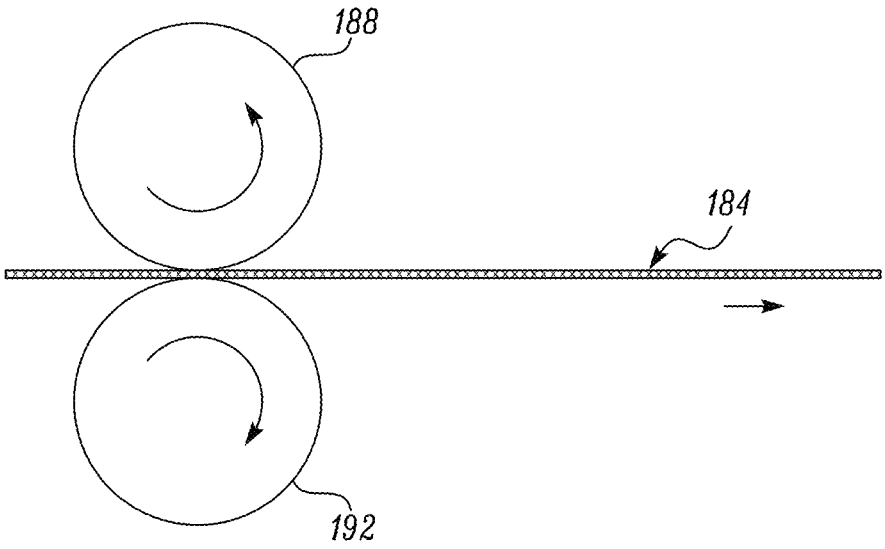
FIGS. 7A through 7I are views illustrating an exemplary method of manufacturing the brief, in accordance with some embodiments.
Figure 7B:
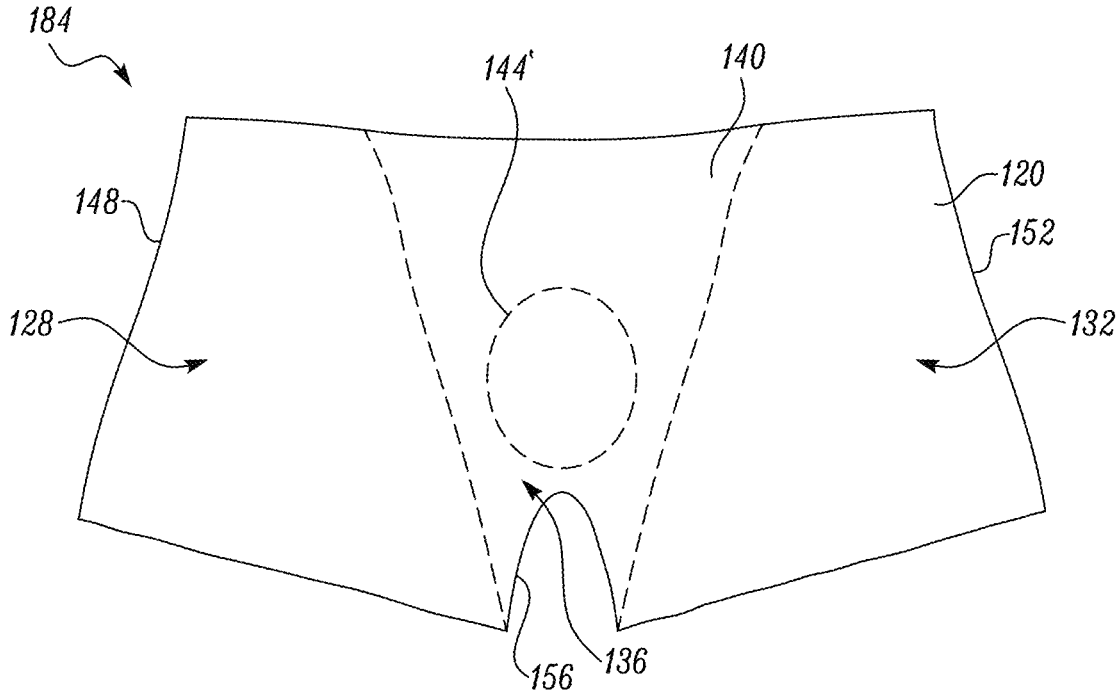

In further detail, the first stretchable fabric 120 defines a first leg portion 128, a second leg portion 132, and a first crotch portion 136 integrally and contiguously extending between the first leg portion 128 and the second leg portion 132. Similar portions are available in the second stretchable fabric 124, as well. The first crotch portion 136 defines the pouch 108 to enclose the genitals of the male wearer 104 when the brief 100 is worn by the male wearer 104. To this end, the first crotch portion 136 defines a first section 140 and a second section 144. In this regard, reference is also made to FIG. 7B which illustrates the first stretchable fabric 120 in a state prior to the formation of the pouch 108. In FIG. 7B, the first stretchable fabric 120 includes the first section 140 and a second section 144'. It will be noted that similar reference numerals 144 and 144', as used here, refer to the same region of the first crotch portion 136 with the distinction that '144' relates to a state (for example, a stretched state) of said region subsequent to the formation of the pouch 108, while '144"' relates to a state (for example, a non-stretched state) of said region prior to the formation of the pouch 108. Aspects of the present description describe the formation of the pouch 108 (and thus of the second section 144) from the second section 144' by way of an exemplary method of manufacturing the brief 100. Said method will be described further below. Also, as shown in FIGS. 1 through 6, the first section 140 is external to the second section 144, or, alternatively, is devoid of the second section 144. In other words, the first section 140 is a remaining section of the first crotch portion 136 separate and apart from the second section 144.

As is viewed from various views of the brief 100 in FIGS. 1 through 6, as the pouch 108 is converted and obtained from the second section 144 of the first crotch portion 136, the pouch 108 is formed integrally to the first section 140 of the first crotch portion 136. Moreover, the pouch 108 defines no seams with the first section 140. More particularly, for the formation of the pouch 108, the second section 144 is stretched outwardly to a stretched state to define a bulge, BU, with respect to the remaining section or the first section 140 of the first crotch portion 136. As the second section 144' is merely stretched away from the first crotch portion 136 and is not an add-on to the first crotch portion 136, the pouch 108 is integral (for example, seamlessly integral) with the remaining section or the first section 140 of the first crotch portion 136. A fabric matrix corresponding to the first section 140 (and optionally additionally corresponding to one or more of the first leg portion 128 and the second leg portion 132) defines a plurality of first holes. A fabric matrix corresponding to the pouch 108 defines a plurality of second holes. According to some embodiments, the dimensional sizes of the second holes are larger than the dimensional sizes of the first holes.

According to some embodiments, the first holes define a diameter anywhere in a first range of 0.01 mm to 0.024 mm in between warp and filament yarn. According to some embodiments, the second holes define a diameter anywhere in a second range of 0.025 mm to 0.05 mm in between warp and filament yarn. In some examples, the lower limit of 0.025 mm of the second range for the second holes of the pouch 108 is optimal for application in men's garments that are related to sports activities, while the upper limit of 0.05 mm of the second range for the second holes of the pouch 108 is optimal for application in men's garments such as a recovery underwear.

With the relatively larger second holes in the pouch 108, the second holes serve as aeration holes of the pouch 108 that allows relatively more air to pass across the fabric matrix of the pouch 108 when the brief 100 is worn by the male wearer 104. This makes the pouch 108 (formed by the second section 144) more breathable than the first section 140 and/or also more breathable than other portions of the first stretchable fabric 120 and, in some embodiments, optionally additionally, the second stretchable fabric 124. Apart from providing greater breathability, the larger, second holes also provide for lowering humidity and improved heat dissipation from a groin area of the male wearer 104, thus enabling the wearer's genitals to remain at an optimal temperature range. While the bulge, BU, defined by the pouch 108 provides adequate space for the wearer's genitals to be accommodated within the brief 100, the bulge, BU, also appropriately supports the wearer's genitals, in turn promoting wearer comfort and sperm health.

In some embodiments, one or more of the first stretchable fabric 120 and the second stretchable fabric 124 (or the satin weave synthetic composite fabric of one or more of the first stretchable fabric 120 and the second stretchable fabric 124) is formed from a polyamide weave transformed into a satin weave and thinned out. Moreover, in some embodiments, one or more of the first stretchable fabric 120 and the second stretchable fabric 124, with the satin weave synthetic composite fabric, includes elongated nano fibres having a length anywhere between ten (10) to hundred (100) microns. In some embodiments, the satin weave synthetic composite fabric of one or more of the first stretchable fabric 120 and the second stretchable fabric 124 includes polyester. Further, in some embodiments, the first crotch portion 136 includes a synthetic compound, associated with the polyester. In one example, the synthetic compound takes up to fifteen percent (15%) of the weight in the first stretchable fabric 120 or in the brief 100. In some embodiments, a portion (for example, a non-synthetic part) of the brief 100, which is devoid of the synthetic compound, takes up to eighty five percent (85%) of the weight in the first stretchable fabric 120 or in the brief 100.

As an example, both the first section 140 and the second section 144 (and understandably the second section 144') include the synthetic compound. However, it will be appreciated that the pouch 108 (or the second section 144 formed by the second section 144') includes a melted, infused, and solidified volume of the synthetic compound. The solidified volume of the synthetic compound enables the pouch 108 to be retained in the stretched state, with the bulge, BU. A manner in which the synthetic compound is melted, infused, and solidified, will be described later in the present description. In some embodiments, the synthetic compound includes or corresponds to polyethylene terephthalate (PET).

Figure 8:
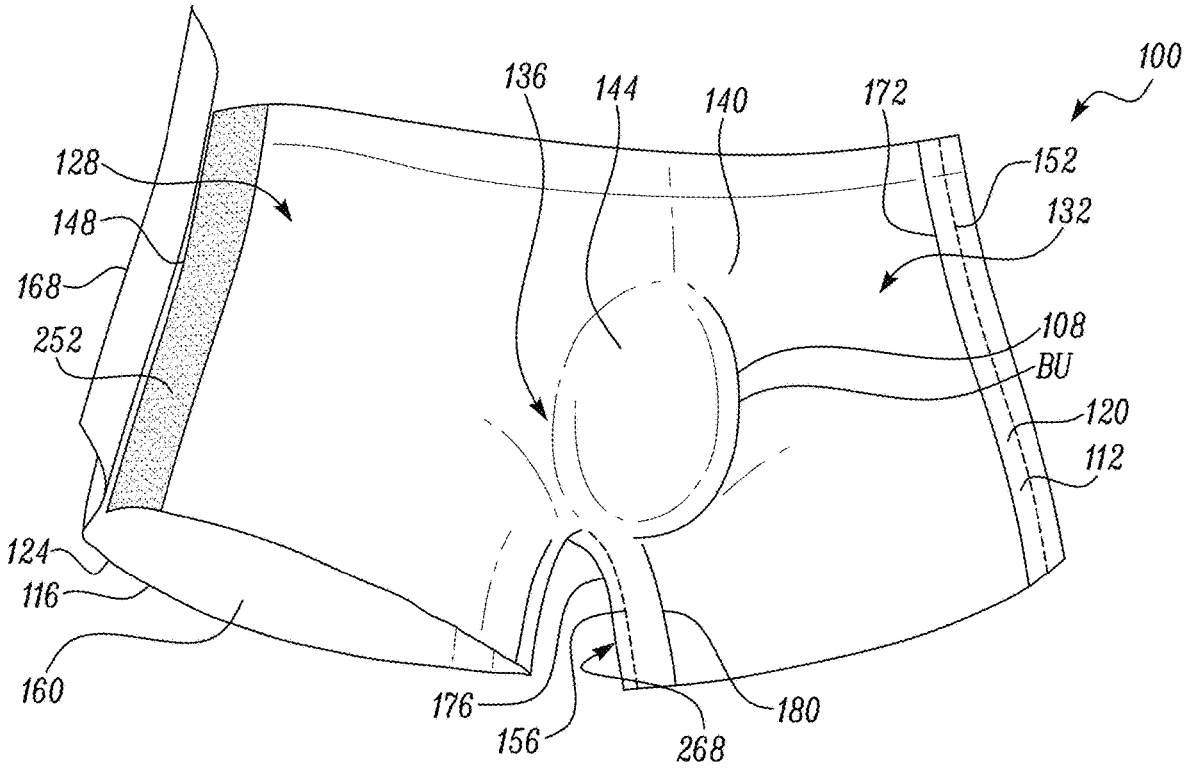
FIG. 8 is a view in which a front panel of the brief is adhered to, or is in an exemplary process of adhering to, a rear panel of the brief, in accordance with some embodiments.

With continued reference to FIGS. 1 through 6, and also in conjunction with FIGS. 7B and 8, the first leg portion 128 defines a first side edge 148 and the second leg portion 132 defines a second side edge 152. Further, the first crotch portion 136 defines a first crotch periphery 156. With the second stretchable fabric 124 being similar (for example, in shape) to the first stretchable fabric 120, the second stretchable fabric 124 defines similar leg portions, for example, a third leg portion 160 and a fourth leg portion 164 (also see FIG. 3). The third leg portion 160 defines a third side edge 168 and the fourth leg portion defines a fourth side edge 172. Also, the second stretchable fabric 124 includes a second crotch portion 176 integrally and contiguously extending between the third leg portion 160 and the fourth leg portion 164. The second crotch portion 176 defines a second crotch periphery 180. While it is notable that the portions in the first stretchable fabric 120 and the second stretchable fabric 124 are similar, they need not be identical. This is because each of the first stretchable fabric 120 and the second stretchable fabric 124 are configured to adapt and conform to different parts of wearer's body.

In some embodiments, one or more of the first stretchable fabric 120 and the second stretchable fabric 124 is a synthetic composite fabric of approximately eighty six percent (86%) CREORA® Polyamide and approximately fourteen percent (14%) SPANDEX® or LYCRA®. The term 'approximately', as used here, accounts for tolerances when manufacturing the brief 100. In some embodiments, one or more of the first stretchable fabric 120 and the second stretchable fabric 124 includes elongated nano fibres making up each corresponding thread and which allows for greater strength and stretch recovery of the corresponding fabric. In some embodiments, one or more of the first stretchable fabric 120 and the second stretchable fabric 124 is made using a conventional polyamide weave that is transformed to a satin weaved and thinned out, as described above. In some embodiments, one or more of the first stretchable fabric 120 and the second stretchable fabric 124 has a thickness anywhere within the range of 0.0045-0.0048 millimetres (mm).

Figure 9:
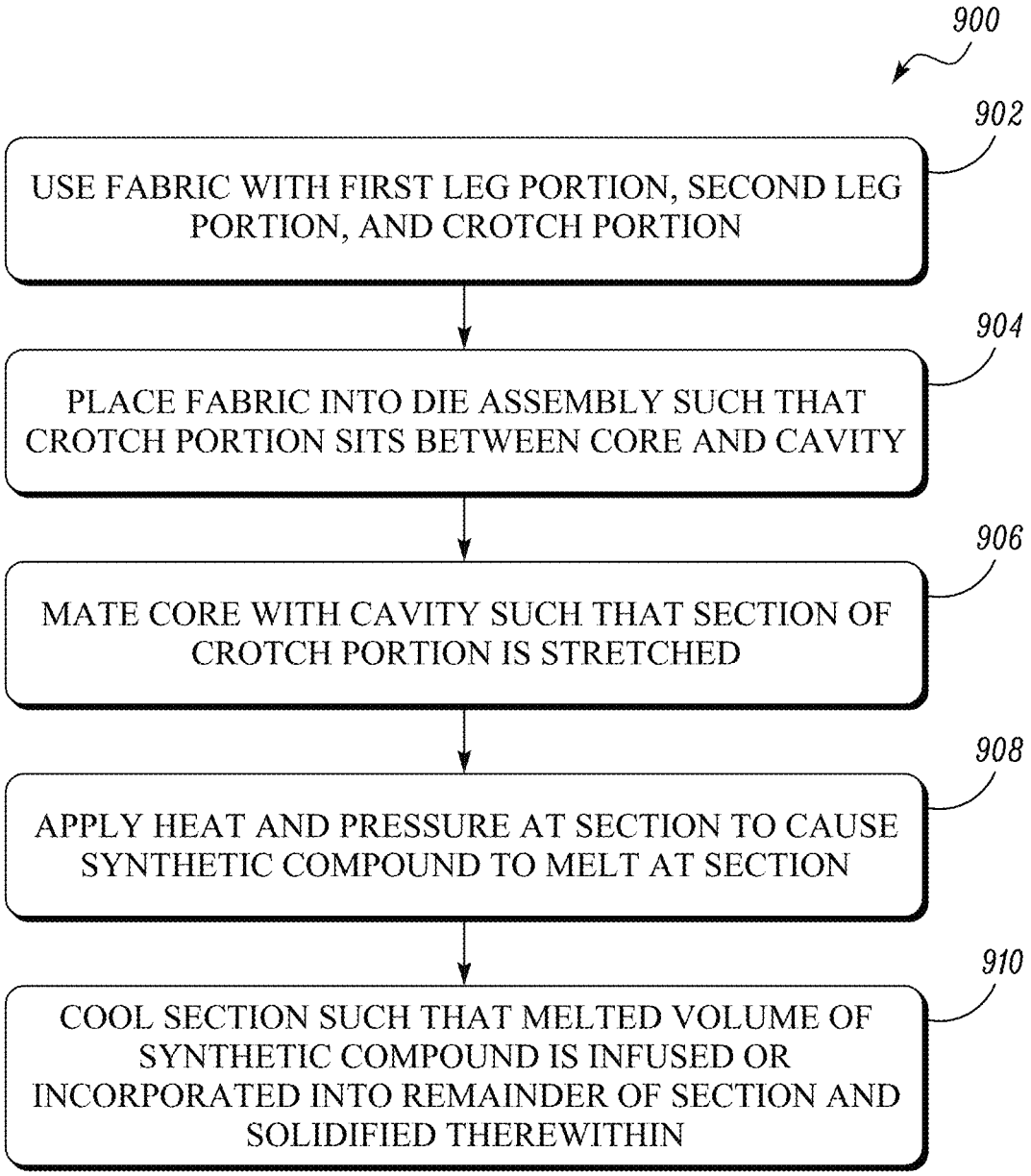
FIG. 9 is a flowchart iterating various stages in an exemplary process of manufacturing the brief, in accordance with some embodiments.

Referring to FIGS. 7A through 7I and FIG. 8, an exemplary method of manufacturing the brief 100 is described. The method is also described by way of a flowchart 900 illustrated in FIG. 9. The flowchart 900 includes different stages of the method of manufacturing the brief 100, and the stages are indicated by various blocks 902, 904, 906, 908, and 910. The stages need not necessarily be viewed to be in any chronological order. The method starts at block 902.

At block 902, a base fabric 184 (for example, a relatively enlarged flat piece of stretchable fabric) (see FIG. 7A) is used and a profile of the first stretchable fabric 120 is generated on the base fabric 184. Such profile generation, in an embodiment, is performed by using one or more of a template, a stencil, and/or the like devices, associated with the brief 100 and which is then used to form the brief 100. A suitable tool (not shown) is then applied to shear or cut out and remove the first stretchable fabric 120 from the base fabric 184 such that the first stretchable fabric 120 is formed, independent of the base fabric 184. The first stretchable fabric 120, as obtained, defines the aforementioned the first leg portion 128, the second leg portion 132, and the first crotch portion 136 (see FIG. 7B). The first stretchable fabric 120 is used for the production of the brief 100. Although not limited, the first stretchable fabric 120, as obtained from the base fabric 184, in an embodiment, is obtained as a flat piece of stretchable fabric, for example, which is devoid of any three-dimensional (3D) contours and/or shapes and/or structures. Also, one or both of the base fabric 184 and/or the first stretchable fabric 120 is heat pressed on steel rollers 188, 192 to reduce a coefficient of friction of the first stretchable fabric 120 and/or of the brief 100. In some embodiments, the description corresponding to the first stretchable fabric 120, as described in relation with the block 902, is suitably applicable for the second stretchable fabric 124, as well, for the production of the second stretchable fabric 124. The method proceeds to block 904.

At block 904, the first stretchable fabric 120 is placed into a die assembly 196 (see FIGS. 7C through 7I). In this regard, the die assembly 196 includes a cavity 200, an intermediate station 204, and a core 208. The intermediate station 204 is arranged in between the cavity 200 and the core 208. The cavity 200 is formed in a first support part 212 of the die assembly 196; the intermediate station 204 is formed in a second support part 216 of the die assembly 196; and the core 208 is formed in a third support part 220 of the die assembly 196.

Figure 7C:
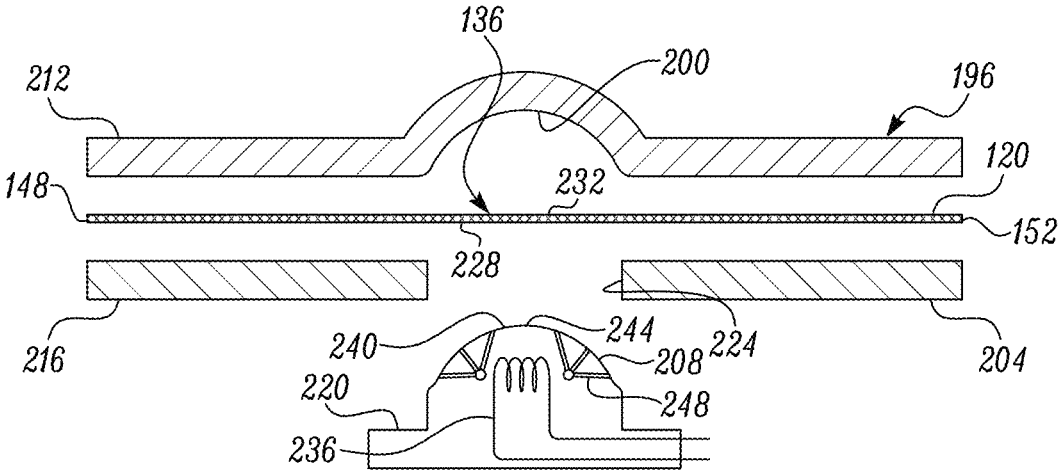

With reference to FIGS. 7C through 7I, the intermediate station 204 defines a through-slot 224, and a placement of the first stretchable fabric 120 into the die assembly 196 means that the first stretchable fabric 120 is laid onto the intermediate station 204 such that the first crotch portion 136 lies over the through-slot 224, and/or, in other words, the first crotch portion 136 fully overlaps the through-slot 224. Also, at said block 904, the placement of the first stretchable fabric 120 into the die assembly 196 means that the first crotch portion 136 of the first stretchable fabric 120 sits between the core 208 and the cavity 200 of the die assembly 196, with one side 228 of the first crotch portion 136 facing the core 208 and the other side 232 of the first crotch portion 136 facing the cavity 200. In this regard, and as shown in FIG. 7C, for example, the core 208 is defined or positioned below the cavity 200 and lies in alignment to the each of the cavity 200 and the through-slot 224. The method proceeds to block 906.

At block 906, the die assembly 196 is operated to mate the core 208 with the cavity 200. During the mating of the core 208 with the cavity 200, the core 208 passes through the through-slot 224 such that the core 208 is able to ingress or enter into the cavity 200 (see direction, A, FIGS. 7E and 7F) from below. By way of having the core 208 enter into the cavity 200, or by way of mating the core 208 with the cavity 200, with the first stretchable fabric 120 and/or on the first crotch portion 136 arranged in between the core 208 and the cavity 200, an exemplary molding operation on the first stretchable fabric 120 and/or on the first crotch portion 136 of the first stretchable fabric 120 is performed.

Figure 7D:
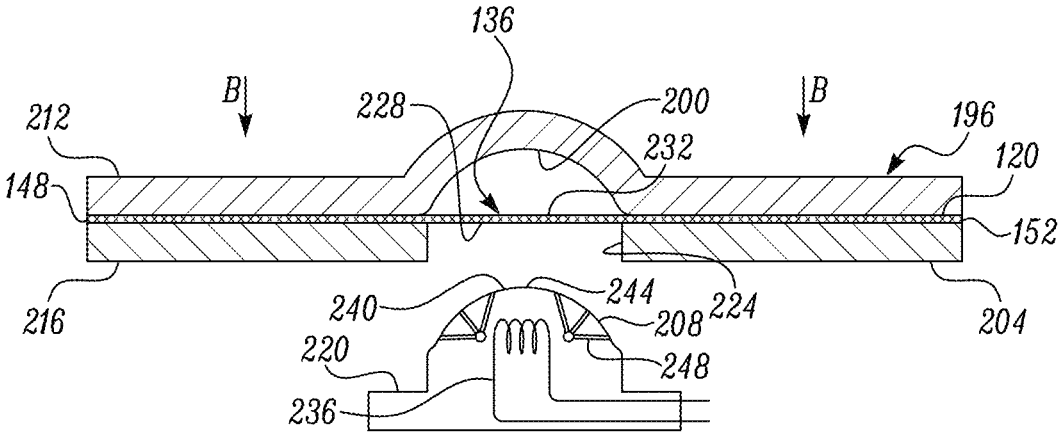

When operating the die assembly 196 for mating the core 208 with the cavity 200 or prior to the mating the core 208 with the cavity 200, one of the first support part 212 and the second support part 216 is moved (see direction, B, FIG. 7D)

towards the other of the first support part 212 and the second support part 216 such that the first support part 212 and the second support part 216 come into physical contact with each other. In so doing, one support part (for example, the first support part 212) impinges against the other support part (for example, the second support part 216) and the first stretchable fabric 120 (and, more particularly, the remaining section or the first section 140 of the first crotch portion 136, positioned in between the first support part 212 and the second support part 216) is clinched and/or restrained (for example, tightly) between portions of the first support part 212 and the second support part 216. At this point, the second section 144' remains exposed to the core 208 and to the cavity 200.

Figure 7E:
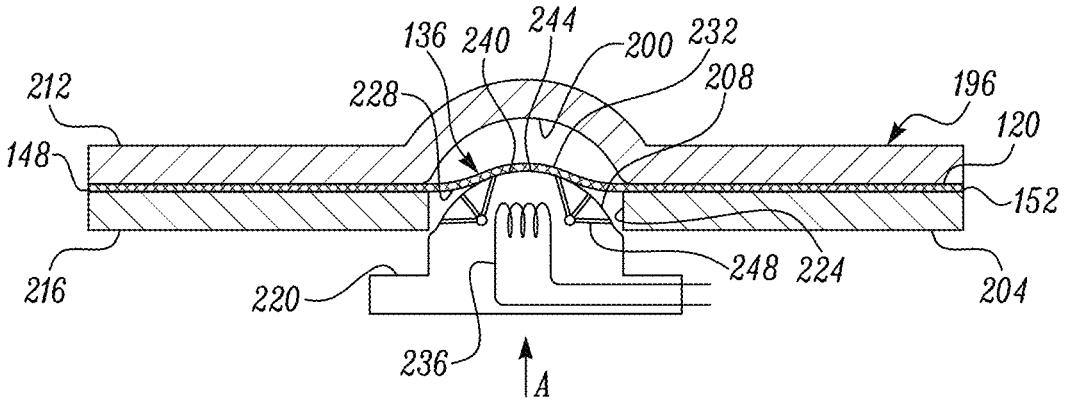
Figure 7F:
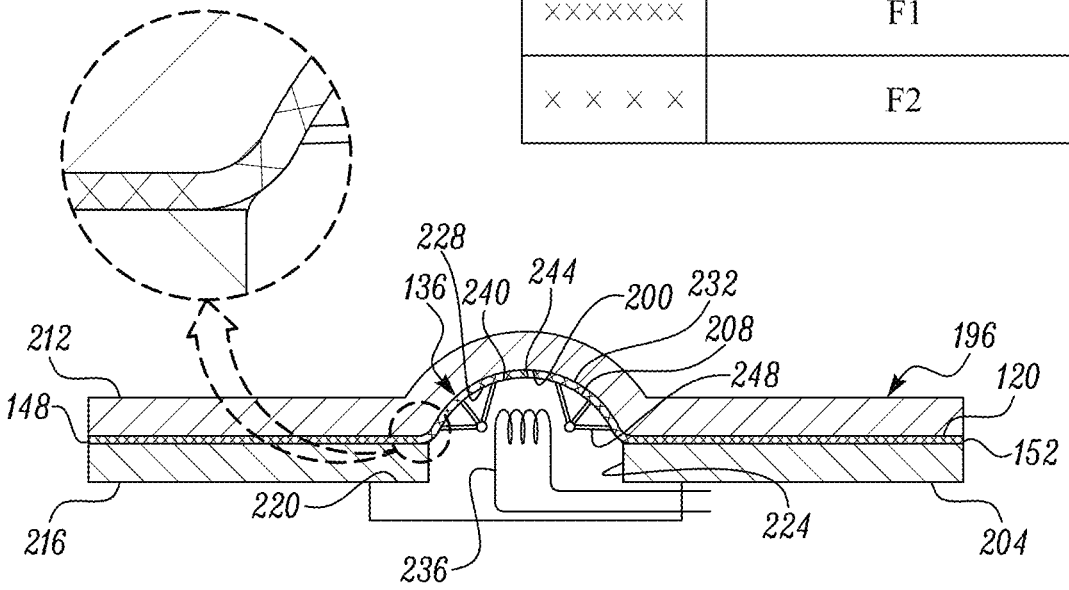
Figure 7G:
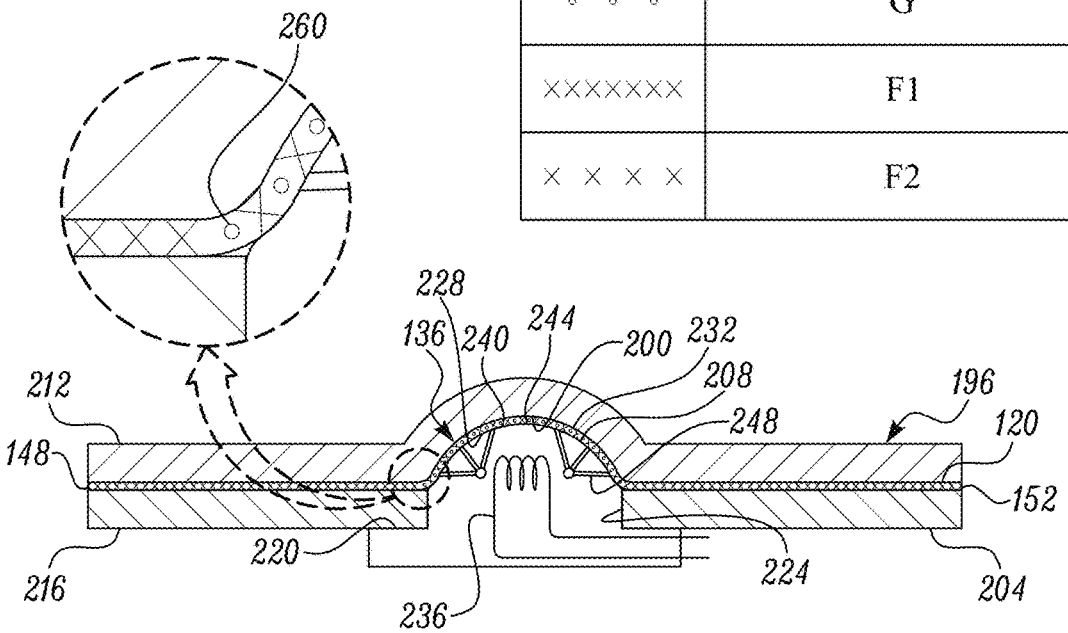
Figure 7H:
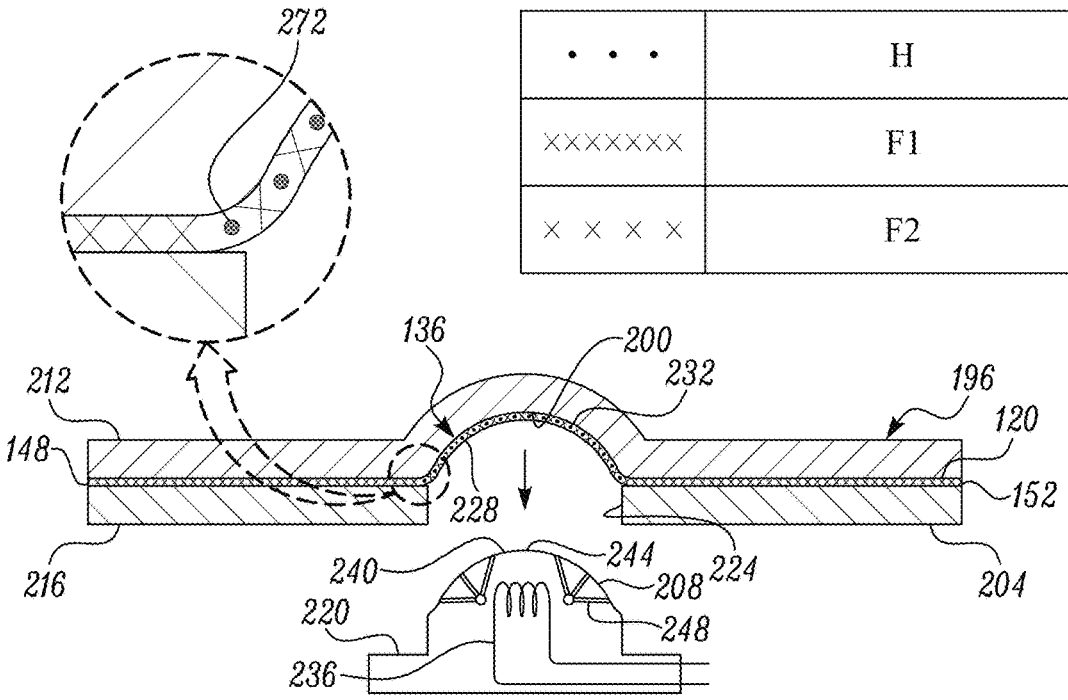
Figure 7I:
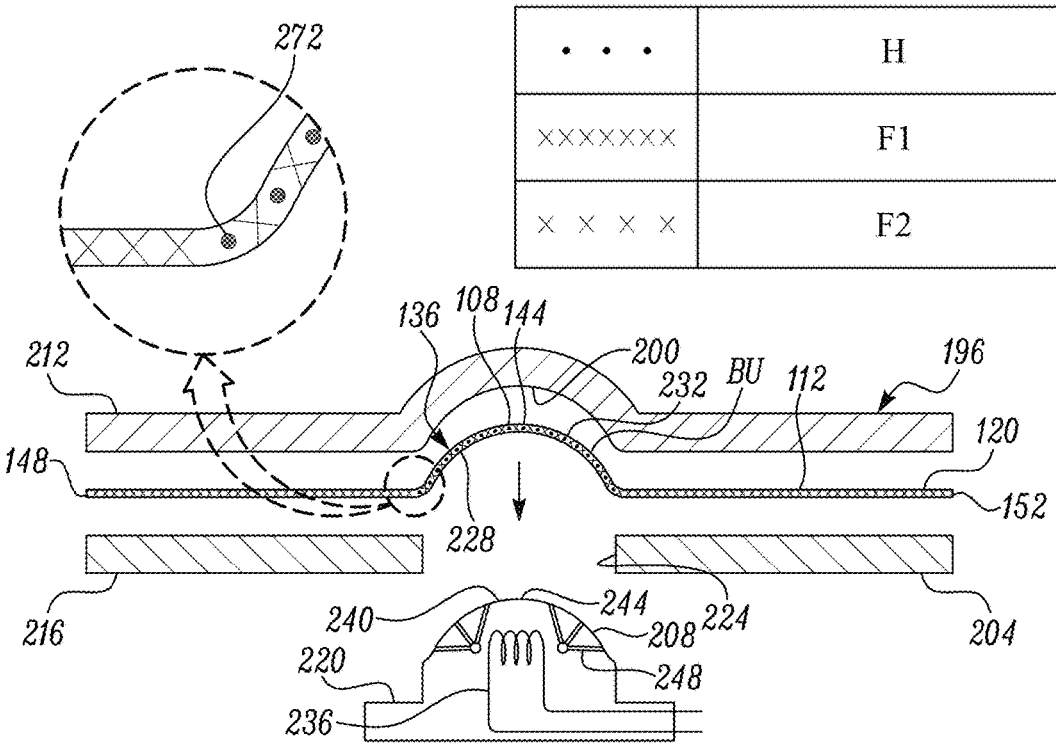

With reference to FIGS. 7E and 7F, as part of a continued operation of the die assembly 196, or as the core 208 enters into the cavity 200 (for example, for mating with the cavity 200), the core 208 pushes the second section 144' of the first crotch portion 136 into the cavity 200 such that the second section 144' is stretched from the non-stretched state (as it was when lying unattended and/or undisturbed on the second support part or the intermediate section at block 904) to the stretched state. The non-stretched state of the second section 144' is visualized from FIG. 7D and the stretched state of the second section 144' is visualized from FIG. 7F through 7I. In other words, the second section 144' is pushed to the stretched state with respect to the remaining section or the first section 140 of the first crotch portion 136. The remaining section or the first section 140, at this point, continues to stay clinched and restrained between portions of the first support part 212 and the second support part 216, as described above. In Table 1, as provided in FIG. 7F, reference, F1, corresponds to a non-stretched or unstretched fabric part and reference. F2, corresponds to a stretched fabric part. The method proceeds to block 908.

At block 908, once the core 208 fully enters into the cavity 200 and is mated with the cavity 200 (referred to as a 'mated state' of the core 208), the core 208 exerts pressure against the cavity 200 such that the pressure is transferred and thus applied to the second section 144' received between the core 208 and the cavity 200. This pressure application causes the second section 144' to sit snugly and/or tightly within the cavity 200 (see FIG. 7F), urging the second section 144' to take a shape of the cavity 200. In some embodiments, simultaneously with the application of pressure, heat is applied to the second section 144', as well. Both the application of heat and pressure causes a volume of the synthetic compound (see FIG. 7G), for example, a volume of PET of the second section 144', to be subject to phase change and/or to melt. The melting occurs while retaining the second section 144' in the stretched state and with the second section 144' sitting tightly within the cavity 200, as the second section 144' is pushed by the core 208 into the cavity 200. In Table 2, as provided in FIG. 7G, reference, G, corresponds to melted synthetic compound. Also, as provided in Table 2, reference. F1, corresponds to the non-stretched or unstretched fabric part and reference, F2, corresponds to the stretched fabric part.

In some embodiments, the heat is supplied to the second section 144 through the core 208. To this end, and as an example, the core 208 includes features, such as one or more heating elements 236 that convert any supplied energy, at least in part, into heat, and through which heat is applied and/or imparted to the second section 144'. As an example, a source from where energy is supplied for the production of heat at the core 208 corresponds to any heat source, for example, an electrical heat source (not shown). In some embodiments, heat application is uniform about a body 240 of the core 208. In so doing, a physical state (for example, an initial solid state) of the synthetic compound, present in and across the second section 144' of the first crotch portion 136, is uniformly altered or melted. In other words, a temperature at an outer surface 244 of the core 208 is varied evenly across an expanse of said outer surface 244 of the core 208. In so doing, a phase change of the synthetic compound in and across the second section 144' of the first crotch portion 136 is attained uniformly throughout the second section 144. In some embodiments, the temperature is evenly varied at the outer surface 244 of the core 208 by having the heating elements 236 evenly distributed across the expanse of the outer surface 244 of the core 208. Although not limited, the second section 144' is retained in the stretched state for an entire duration of the melting of the synthetic compound.

In some embodiments, a temperature value during an application of the heat is anywhere between 330.2 degrees fahrenheit to 402 degrees fahrenheit. In some embodiments, a pressure value during an application of the pressure is anywhere between 3.899 pounds per square inch to 7.024 pounds per square inch. In some embodiments, the heat is applied for a period of at least 10.05 seconds from start and up to a maximum of 13.03 seconds. In some embodiments, the pressure is applied for a period of at least 10.05 seconds from start and up to a maximum of 13.03 seconds. In some embodiments, the period for heat and pressure application is same when they are applied simultaneously. In some embodiments, the period for each of the heat and the pressure application varies or changes within or with respect to the ranges provided above according to a material of the first stretchable fabric 120. The method proceeds to block 910.

At block 910, after the heat and pressure have been applied in accordance with the ranges provided above, the heat application is halted and the operation switches to the cool the second section 144' such that the volume of the synthetic compound that is melted (referred to as a 'melted volume 260') (see FIG. 7G) at block 908 is infused or incorporated back into the second section 144' (for example, into a remainder of the second section 144'). The synthetic compound is then left to be solidified therewithin (referred to as a 'solidified volume 272') (see FIGS. 7H and 7I). Such cooling and the ensuing solidification cause the second section 144' to be retained in a shape, for example, as that or similar to what was acquired in the stretched state, thereby forming the second section 144 and thus the pouch 108 in the first crotch portion 136. In Tables 3 and 4, as respectively provided in FIGS. 7H and 7I, reference. H, corresponds to solidified synthetic compound. Also, as provided in Tables 3 and 4, reference, F1, corresponds to the non-stretched or unstretched fabric part and reference. F2, corresponds to the stretched fabric part.

The solidification enables the pouch 108 to be retained in said shape, for example, with the bulge, BU. Further, the pouch 108, as formed from the same fabric as that of the first crotch portion 136, is seamlessly merged and/or integrated with the remaining section or with the first section 140 of the first crotch portion 136. This is beneficial over cases where a different fabric piece is applied and which is stitched to the first crotch portion 136 to form a pouch, similar to the pouch 108, as stitching a different fabric externally to any section of the first crotch portion 136 inevitably defines a seam (for example, a suture-based seam) at the first crotch portion 136. During use by the male wearer 104, such suture-based seams are observed to undesirably cause chaffing of a skin of the male wearer 104. The method ends at block 910, although a variety of other processes are contemplatable by someone skilled in the art in subsequence to block 910.

In some embodiments, the cooling is performed while retaining the second section 144' in the stretched state. At this point, 'retaining the second section 144 in the stretched state' means that the either the core 208 continues to be in the mated state with the cavity 200 to keep the second section 144' in the stretched state, or, that the core 208 moves away from the cavity 200 to an unmated state but the second section 144' continues to remain in the stretched state owing to the heat and pressure applied to the second section 144' at block 908 and/or owing to the melting of the synthetic compound at the second section 144' at block 908.

In some embodiments, cooling is provided by natural convection. For example, natural convention includes the allowance of a natural flow of air across the second section 144' (for example, immediately) after the melting of the synthetic compound or immediately after the period for which the heat and/or the pressure is applied. In some embodiments, the solidification of the synthetic compound incorporated into the second section 144' takes about thirty (30) seconds. Additionally, or optionally, cooling is provided by one or more additional systems associated with the die assembly 196. As an example, the core 208 includes cooling channels 248 through which a cooled fluid, such as cooled air, is passed and transferred (or applied) to the second section 144' such that the volume of the synthetic compound that is melted (or the melted volume) is solidified, while retaining the second section 144' in the stretched state and thus turning the same into the second section 144 and/or the pouch 108.

In some embodiments, the second section 144' is stretched from the non-stretched state to the stretched state to increase sizes of holes defined in the second section 144 (or in the fabric matrix of the second section 144) from relatively smaller hole sizes to relatively larger hole sizes. As an example, holes in the second section 144 are switched from being the first holes to the second holes-more specifically, as the second section 144' is stretched to the stretched state, diameter of the holes in the second section 144' moves from being anywhere between 0.01 mm to 0.024 mm in between warp and filament yarn to anywhere between 0.025 mm to 0.05 mm in between warp and filament yarn. Also, when the melted volume of the synthetic compound is infused or incorporated into the second section 144' (or into the remainder of the second section 144') and solidified therewithin, the larger sizes of holes, as achieved in the stretched state of the second section 144 or as achieved in the second section 144, are retained so, without returning to the hole size they were in when in the non-stretched state.

Referring to FIG. 8, to form the brief 100, each of the first stretchable fabric 120 and the second stretchable fabric 124 is used. More particularly, the first side edge 148 with the third side edge 168 are overlapped over each other and a first adhesive volume 252 between the first side edge 148 and the third side edge 168 is used to fuse and join the first side edge 148 with the third side edge 168. This enables the formation of a first suture-less and seamless joint 256 of the brief 100. Similarly, the second side edge 152 with the fourth side edge 172 are overlapped over each other and a second adhesive volume (not shown but is similar to the first adhesive volume 252) is used between the second side edge 152 and the fourth side edge 172 to fuse and join the second side edge 152 with the fourth side edge 172. This enables the formation of a second suture-less and seamless joint 264 of the brief 100, laterally oppositely to the first suture-less and seamless joint 256 of the brief 100. Examples of the adhesive include, but are not limited to, hotmelt adhesives, ethyl vinyl acetate, polyamide-based hot melt adhesives, and the like.

Moreover, the first crotch periphery 156 and the second crotch periphery 180 are also overlapped with each other and a third adhesive volume (not shown but is similar to the first adhesive volume 252) is used between the first crotch periphery 156 and the second crotch periphery 180 to fuse and join the first crotch periphery 156 with the second crotch periphery 180. This enables the formation of a third suture-less and seamless joint 268 of the brief 100. In so doing, and with the first stretchable fabric 120 and the second stretchable fabric 124 being heat pressed (for example, the base fabric 184 (see FIG. 7A) is heat pressed prior to its placing into the die assembly 196) the brief 100 as formed, possess a smooth and/or a body friendly texture and contours for the male wearer 104.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover, in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element preceded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the description. This method is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

I claim:

1. A method for manufacturing a brief for a male wearer, the method comprising:

using a stretchable fabric defining a first leg portion, a second leg portion, and a crotch portion integrally and contiguously extending between the first leg portion and the second leg portion;

placing the stretchable fabric into a die assembly such that the crotch portion sits between a core and a cavity of the die assembly;

mating the core with the cavity to cause the core to push a section of the crotch portion into the cavity such that the section is stretched from a non-stretched state to a stretched state with respect to a remaining section of the crotch portion, the section including a synthetic compound;

applying heat and pressure at the section to cause a volume of the synthetic compound to melt while retaining the section in the stretched state, wherein the heat and the pressure are applied simultaneously for a same period, the same period ranging from 10.05 seconds to 13.03 seconds, a temperature value during an application of the heat being between 330.2 degrees Fahrenheit to 402 degrees Fahrenheit, and a pressure value during an application of the pressure being between 3.899 to 7.024 pounds per square inch (psi); and cooling the section, while retaining the section in the stretched state, such that a melted volume of the synthetic compound is infused or incorporated into a remainder of the section and solidified therewithin to cause the section to acquire a shape as that acquired in the stretched state and be retained in the shape to form a pouch seamlessly integrated with the remaining section of the crotch portion, the pouch configured to enclose genitals of the male wearer when the brief is worn by the male wearer.

2. The method of claim 1, wherein the section is stretched from the non-stretched state to the stretched state to increase sizes of holes defined in the section from relatively smaller hole sizes to relatively larger hole sizes, and when the melted volume of the synthetic compound is infused or incorporated into the section and solidified therewithin, the sizes of holes in the section are retained with the relatively larger hole sizes.

3. The method of claim 1, wherein the stretchable fabric is a first stretchable fabric, the first leg portion defining a first side edge, the second leg portion defining a second side edge, the method further including:

using a second stretchable fabric defining a third leg portion and a fourth leg portion, the third leg portion defining a third side edge and the fourth leg portion defining a fourth side edge;

overlapping the first side edge with the third side edge and using a first adhesive volume therebetween to fuse and join the first side edge with the third side edge, thereby forming a first suture-less and seamless joint of the brief; and overlapping the second side edge with the fourth side edge and using a second adhesive volume therebetween to fuse and join the second side edge with the fourth side edge, thereby forming a second suture-less and seamless joint of the brief.

4. The method of claim 3, wherein the crotch portion is a first crotch portion defining a first crotch periphery, the second stretchable fabric includes a second crotch portion integrally and contiguously extending between the third leg portion and the fourth leg portion, the second crotch portion defining a second crotch periphery, the method further including:

overlapping the first crotch periphery with the second crotch periphery and using a third adhesive volume therebetween to fuse and join the first crotch periphery with the second crotch periphery, thereby forming a third suture-less and seamless joint of the brief.

5. The method of claim 1 further including heat pressing the stretchable fabric on steel rollers to reduce a coefficient of friction of the stretchable fabric prior to placing the stretchable fabric into the die assembly.

6. The method of claim 1, wherein the stretchable fabric includes a satin weave synthetic composite fabric including elongated nano fibres having a length anywhere between ten (10) to hundred (100) microns.

7. The method of claim 1, wherein the stretchable fabric is made using a polyamide weave that is transformed to a satin weave and thinned out.

8. The method of claim 1, wherein the stretchable fabric includes polyester and the synthetic compound includes polyethylene terephthalate (PET).

9. The method of claim 1, wherein the stretchable fabric includes a thickness between 0.0045-0.0048 millimetres (mm).

10. The method of claim 1, wherein the cavity is formed in a first support part of the die assembly, the method including using a second support part of the die assembly to impinge against the first support part when or prior to mating the core with the cavity to clinch and restrain the remaining section of the crotch portion in between the first support part and the second support part.

11. The method of claim 1, wherein cooling is applied to the section for a period of at least thirty (30) seconds.

* * * * *